US005455807A

United States Patent [19]

Nepple et al.

[11] Patent Number: 5,455,807

[45] Date of Patent: Oct. 3, 1995

[54] TIME MAINTENANCE AND DISPLAY IN A TIME KEEPING SYSTEM INCLUDING A TIME ZONE BOUNDARY

[75] Inventors: Bruce C. Nepple, Portland; Garold B. Gaskill, Tualatin, both of Oreg.

[73] Assignees: Seiko Corp.; Seiko Epson Corp., both of Japan

[21] Appl. No.: 108,983

[22] Filed: Aug. 18, 1993

[51] Int. Cl.[6] ..... G04C 11/00

[52] U.S. Cl. ..... 368/47; 368/21

[58] Field of Search ..... 368/47–55, 21–28

[56] References Cited

U.S. PATENT DOCUMENTS 5,089,814 2/1992 DeLuca et al. ..... 340/825.49

5,105,396 4/1992 Ganter et al. ..... 368/47

5,258,964 11/1993 Koma et al. ..... 368/47

*Primary Examiner*—Bernard Roskoski

*Attorney, Agent, or Firm*—Elmer Galbi

[57] ABSTRACT

In a time keeping system providing time of day by radio signal to remote time keeping devices, the transmitted time of day is provided in association with a given time zone identification. The time keeping devices receiving the time of day reference and the time zone identification include a time zone preference identification. By comparing the time zone preference and the time zone identification transmitted, the time keeping device can, when necessary, offset the received time of day value according to user preference for display relative to a preferred time zone.

15 Claims, 4 Drawing Sheets

TIME MAINTENANCE AND DISPLAY IN A TIME KEEPING SYSTEM INCLUDING A TIME ZONE BOUNDARY

BACKGROUND OF THE INVENTION

The present invention relates generally to methods and apparatus for time keeping, and particularly to methods and apparatus for time keeping in a system broadcasting time of day information by radio signal in an area including a time zone boundary.

Highly accurate time reference data is available by radio signal broadcast. Such information is used in a paging system using wristwatch paging devices. In such system, in addition to transmission of paging information, the wristwatch paging devices collect highly accurate time of day information from the paging broadcast protocol. Generally, such time of day information can be taken by the paging device as an accurate local time of day and used to update the time of day for the time keeping portion of the wristwatch paging device. In this manner, the paging devices intermittently receive an accurate time of day update and thereby maintain a highly accurate representation of time for display on the wristwatch paging device.

When the paging system reception area encompasses a time zone boundary, however, the local time of day reference provided in a given radio signal broadcast may not be accurate. Time display and maintenance is complicated when the paging system employs several broadcast facilities, each selectively used by the paging devices by use of a frequency agile receiver, distributed throughout a reception area. Signals broadcast from one facility in or near a given time zone may be received by paging devices in the other time zone. Furthermore, paging devices are likely to traverse the time zone boundary and could be in either one of the time zones at any given time. Thus, while transmission of local time of day information and intermittent updating of a time of day display in paging devices away from time zone boundaries can be as simple as collecting the local time of day information and updating the time keeping portion of the paging device, such procedure cannot be used across and near a time zone boundary. The paging devices should accurately represent local time of day with appropriate reference to a given time zone.

U.S. Pat. No. 5,089,814 issued Feb. 18, 1992 to DeLuca et al and entitled AUTOMATIC TIME ZONE ADJUSTMENT OF PORTABLE RECEIVER shows a portable receiver receiving a signal indicative of the location of the portable receiver. A memory element of the receiver associates the received signal indicative of location with a corresponding time zone. The receiver thereby determines the time zone of its location. Based on such information the device adjusts its time of day to meet the indicated local time zone standard. The disclosure of DeLuca et al does not, however, recognize problems in time keeping associated with a reception area including a time zone boundary.

Thus, it would be desirable to provide a method and apparatus facilitating time keeping by radio signal broadcast in and around a time zone boundary.

SUMMARY OF THE INVENTION

In accordance with the present invention, a radio signal broadcast including time of day information further includes an indication of time zone associated with the transmitted time of day information. Paging devices operating in the reception area include a preference indicator showing user preference for time display relative to a given time zone.

When the paging device seeks time of day information, it compares the indicated time of zone associated with the received time of day information with its preference for a particular time zone. If the indicated time zone for the time of day matches the preference for a particular time zone or if no preference is indicated, then the time of day is accepted as is without modification. On the other hand, if the time zone associated with the transmitted time of day does not match the paging device preference for a particular time zone, then an appropriate offset in the received time of day is executed and the modified time of day is taken as a time reference. In this manner, multiple transmitters in a given reception area including a time zone boundary can deliver accurate time of day information with reference to a particular time zone and paging devices receiving such time of day information can adjust the time of day reference according to a user preference for a particular time zone.

In accordance with one aspect of the present invention, the radio signal broadcast may associate the time of day information as being either in or around a time zone boundary or not in or around a time zone boundary. If the local time of day information is not associated with a time zone boundary, then paging devices can accept the broadcasted local time of day as is without reference to a user preferred time zone. If, however, the local time of day information is associated with a time zone boundary, then the device executes the above-noted procedures of comparing the indicated time zone with a user time zone preference for time display, and possibly offsetting the received time of day according to user preference.

In accordance with another aspect of the present invention, the transmitted local time of day information includes the magnitude of offset between two adjoining time zone boundaries, e.g., a full hour offset or a one-half hour offset, for converting a time of day reference relative to one time zone into a time of day reference for an adjoining time zone.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
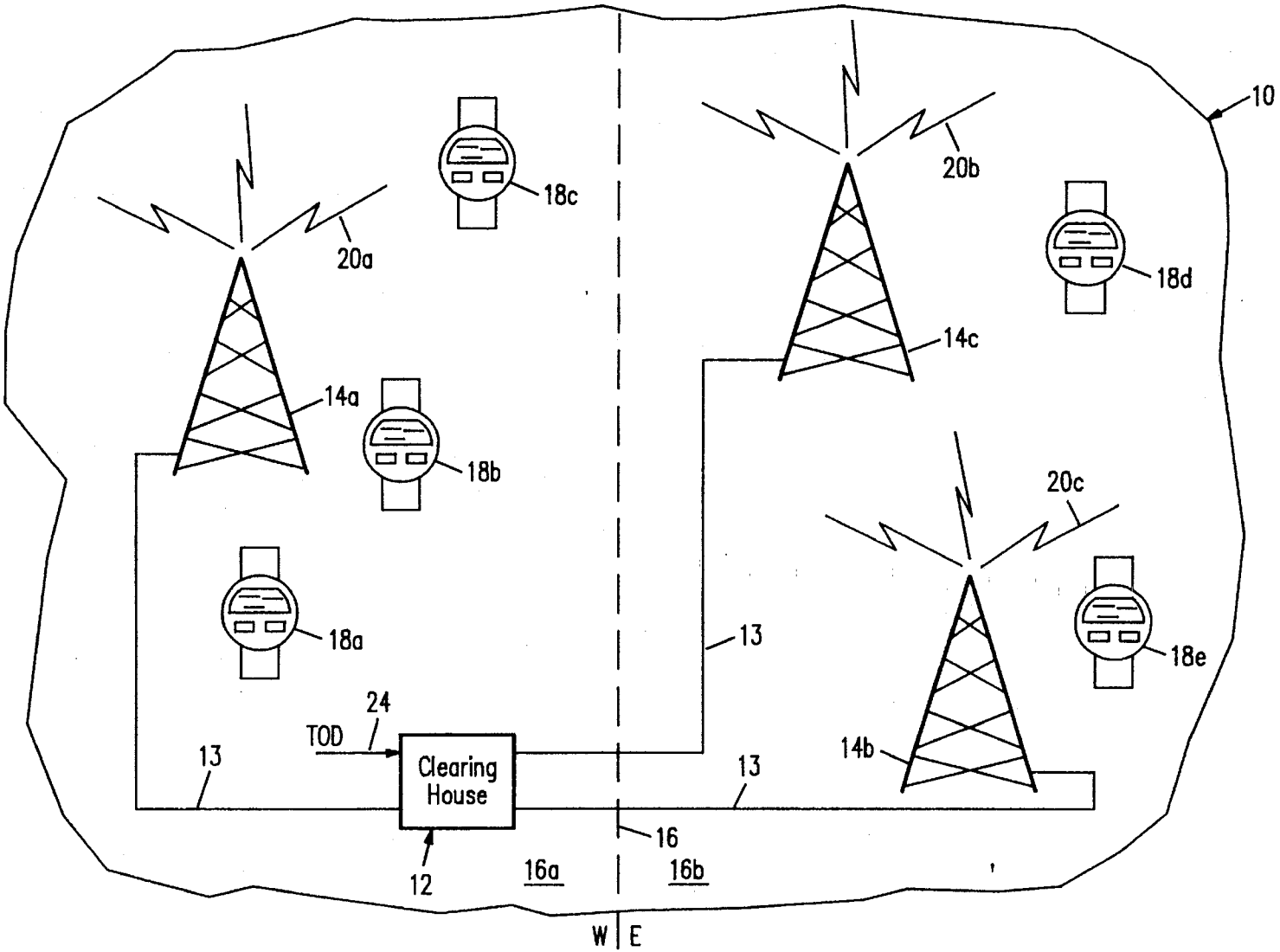
FIG. 1 illustrates schematically a paging system reception area including a time zone boundary and multiple transmission facilities providing, in addition to paging information, a time of day reference for use by paging devices operating within the reception area.

FIG. 1 illustrates a reception area 10 for a paging system including a clearing house 12 providing, e.g., by way of telephone modem connection 13, paging and time of day information to a plurality of transmission facilities 14. The transmission facilities 14, individually 14*a*–14*c*, each transmit on a different frequency and provide paging and time of day information according to a time-multiplexed transmission protocol. Transmission facilities 14 are distributed throughout the reception area 10. Reception area 10 is divided by a time zone boundary 16, defining a west time zone 16*a* and an east time zone 16*b*. Transmission facilities 14 collectively transmit throughout the reception area 10, but individually may cover only a portion of area 10. Paging devices 18, individually 18*a*–18*e*, operate within the reception area 10 and may tune as needed to any one of the signals 20*a*–20*c* provided by the transmission facilities 14*a*–14*c*, respectively.

Clearing house 12 receives a highly accurate time of day reference 24, e.g., National Bureau of Standards WWV signal as provided by radio signal transmission in accordance with known standards. Clearing house 12 uses the time of day reference 24 to broadcast current local time of day information to the paging devices 18 by way of signals 20*a*–20*c*. In this manner, paging devices 18 serving also as time keeping devices may regularly receive highly accurate local time of day information.

Because paging devices 18 may be located anywhere within the reception area 10 and may tune to any one of the transmission facilities 14. Devices 18 must provide time of day with respect to either the west time zone 16*a* or east time zone 16*b*. The local time of day reference transmitted by each of transmission facilities 14 is according to one of the two time zones 16*a* and 16*b*, but users of paging devices 18 may desire time display according to the other one of time zones 16*a* and 16*b*. The subject matter of the present invention provides a method and apparatus for time display in such a system to provide user time display preference as to time zone.

Figure 2:
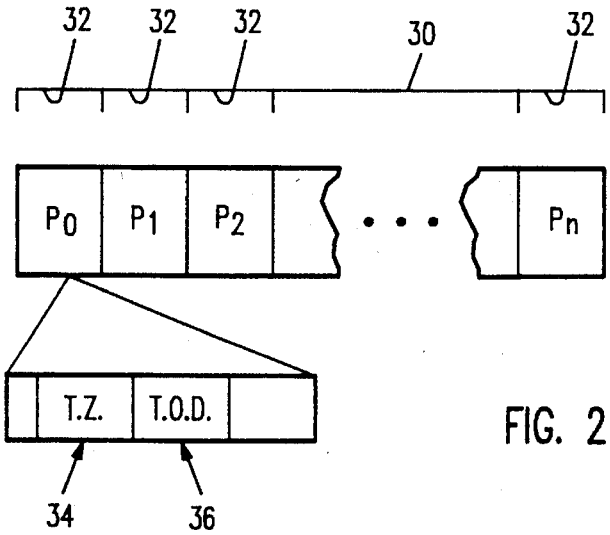
FIG. 2 illustrates generally a transmission protocol of the paging system of FIG. 1 including a time of day information block and an indicated time zone block in implementation of the present invention.

FIG. 2 illustrates generally the transmission protocol of the paging system of FIG. 1. In FIG. 2, a repeating time frame 30 is divided into a series of time slots 32. A sequence of message packets are transmitted, each during a corresponding one of the time slots 32. Each paging device 18 is associated with at least one of the time slots 32 and activates its radio receiving circuitry during that time slot to receive message packets directed to it. The message packets may include additional address information whereby multiple paging devices 18 may share one time slot 32 and thereby identify information packets thereamong.

In addition to transmitting paging message information to the paging devices 18, the protocol of the paging system 12 further includes transmission of local time of day information during a particular one of time slots 32. As illustrated in FIG. 2, the first time slot 32 in time frame 30 provides a packet $P_0$ which includes, in addition to other system control information, a time zone identification field 34 and a time of day field 36. The time zone identification field 34 identifies the time zone associated with the time of day information provided in field 36.

Figure 3:
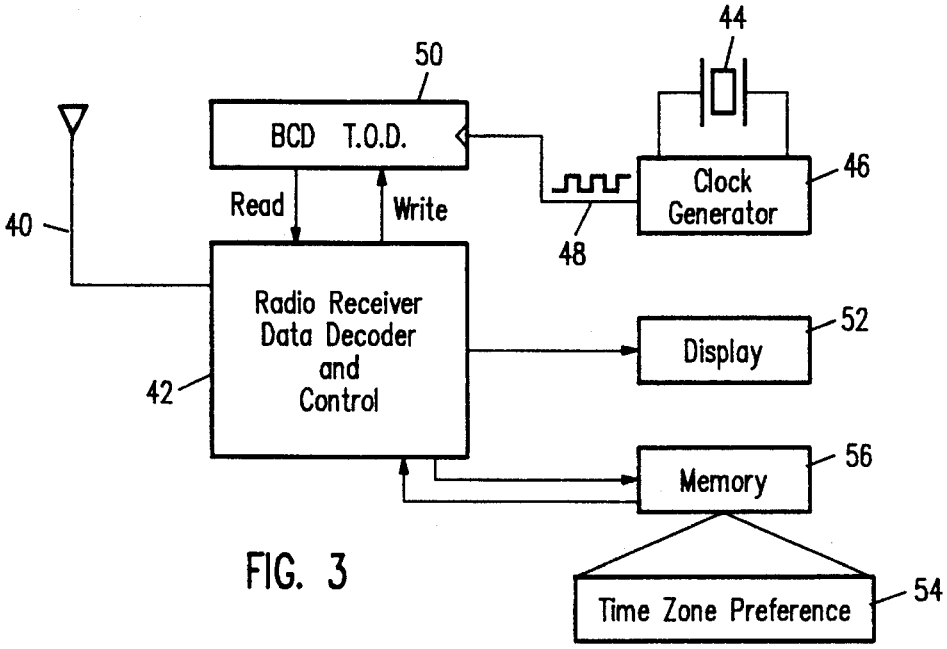
FIG. 3 is a simplified block diagram of a paging device of the paging system of FIG. 1, including a time zone preference register in accordance with the present invention.

FIG. 3 illustrates in schematic form the circuitry of a paging device 18, and in particular the time keeping aspects of the circuitry of paging device 18. In FIG. 3, each paging device 18 includes an antenna 40, for the wristwatch implementation of device 10 antenna 40 is the wristband of device 10. Each device 18 includes a radio receiver, data decoder, and control block 42 receiving and processing information provided by the transmission facilities 14 of the paging system. Each paging device 18 includes a crystal 44 and associated clock generator circuitry 46 for producing a reference clock 48 applied to a binary coded decimal (BCD) time of day register 50. Time of day register 50 is a hardware implemented clock maintaining a binary coded decimal representation of time of day in response to the state changes in reference clock 48. In the preferred implementation of paging device 18, the time of day register 50 may include a one second counter register responsive to the clock 48. The one second counter can then provide a rollover interrupt to control circuitry of block 42 whereby upon rollover of the one second counter the control circuitry can tally hours, minutes, and seconds during an interrupt routine. As presented herein, however, the time of day register 50 may be viewed as storing hours, minutes, and seconds maintained current by way of clock 48, but intermittently updated as a function of a received time of day value taken from field 36 of packet $P_0$.

Control block 42 intermittently reads the time of day register 50 to produce a time of day on a display 52 of paging device 18. Thus, each paging device 18 intermittently, e.g., every half hour, activates its radio receiving circuitry during the first time slot 32 of time frame 30 and captures the message packet $P_0$ to update its time of day register 50. Under such procedure, control block 42 writes a new value into time of day register 50 based upon the time of day field 36 in message packet $P_0$. In accordance with the present invention, however, such updating of the time of day register 50 may further take into account a user preferred time zone as indicated in a time zone preference register 54 of a programmable memory element 56 of paging device 18.

Figure 4:
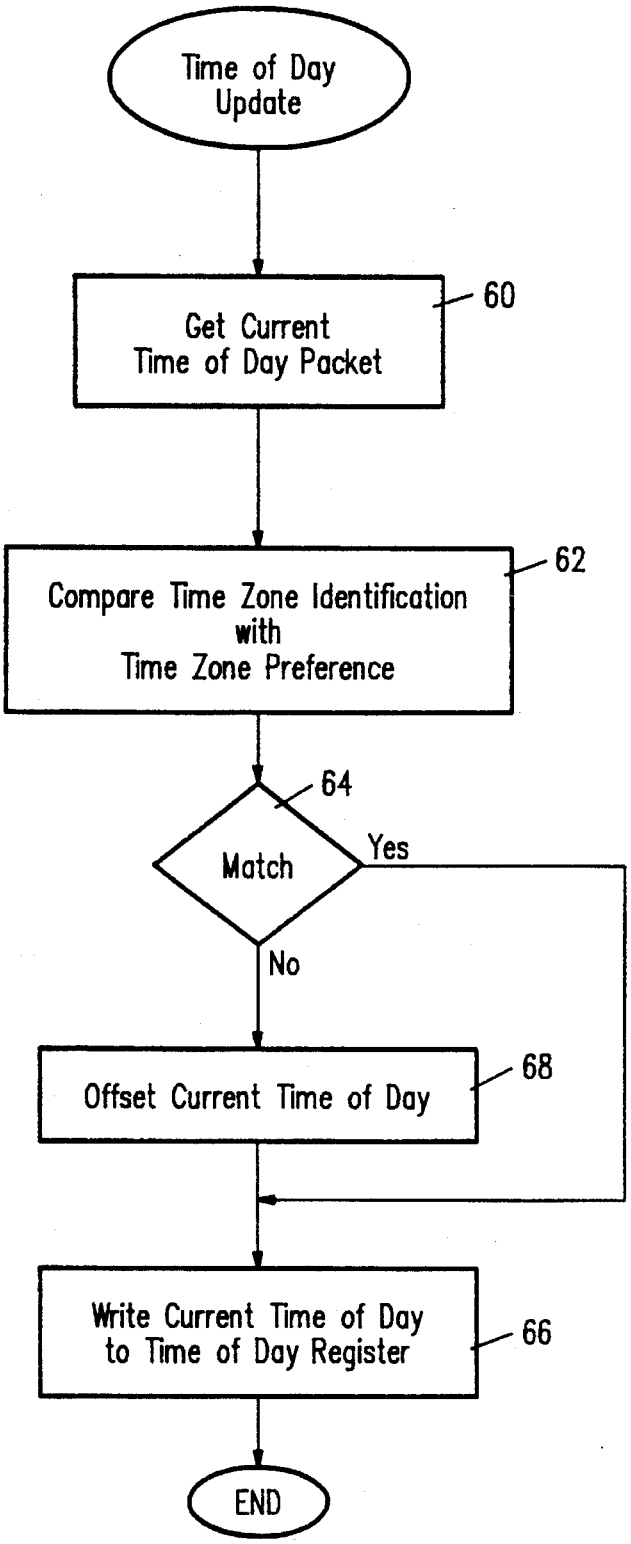
FIG. 4 is a flow chart showing processing within the paging device relative to receiving a current time of day reference and incorporating that reference into a time of day register for time display.

FIG. 4 illustrates programming of the paging device 18 in implementation of the present invention wherein the time zone identification field 34 transmitted in conjunction with the time of day field 36 is compared to the time zone preference register of paging device 18 to display a time of day according to user preference, i.e., according to a user selected time zone. In FIG. 4, a time of day update routine is executed intermittently, e.g., every half hour, to collect a current time of day reference from the paging system 12 and write this value into the time of day register 50 to maintain an accurate representation of time of day. Processing begins in block 60 where paging device 18 obtains the current time of day by activating its radio receiving circuitry and capturing packet $P_0$ according to the paging system time multiplexed protocol. In block 62, paging device 18 compares the time zone identification provided in field 34 of packet $P_0$ with the time zone preference held in its time zone preference register 54. If the compared items match, then processing branches at decision block 64 and goes directly to block 66 where paging device 18 writes the received current time of day into the time of day register 50. As may be appreciated, the received time of day may be suitably offset by a predetermined fixed amount to account for processing time by the paging device 18 following receipt of the time of day reference and prior to writing the time of day reference into time of day register 50.

If the time zone identification field 34 does not match the time zone preference value held in register 54, however, processing branches from decision block 64 to block 68 where paging device 18 offsets the current time of day value as a function of the value held in the time zone identification field 34 and the value of the time zone preference register 54. As may be appreciated, a variety of mechanisms may be provided to implement such user preference for time display according to a given time zone.

Figure 5:
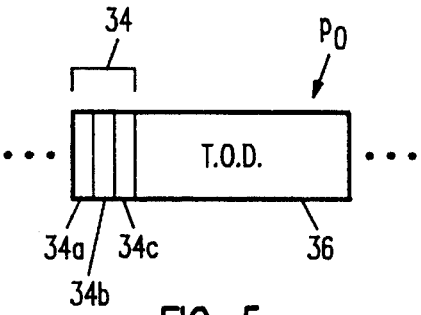
FIGS. 5–7 illustrate a preferred form of the present invention dealing with time display in a reception area overlapping two adjacent time zones.
Figure 6:
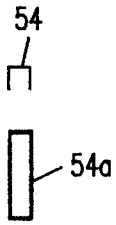
Figure 7:
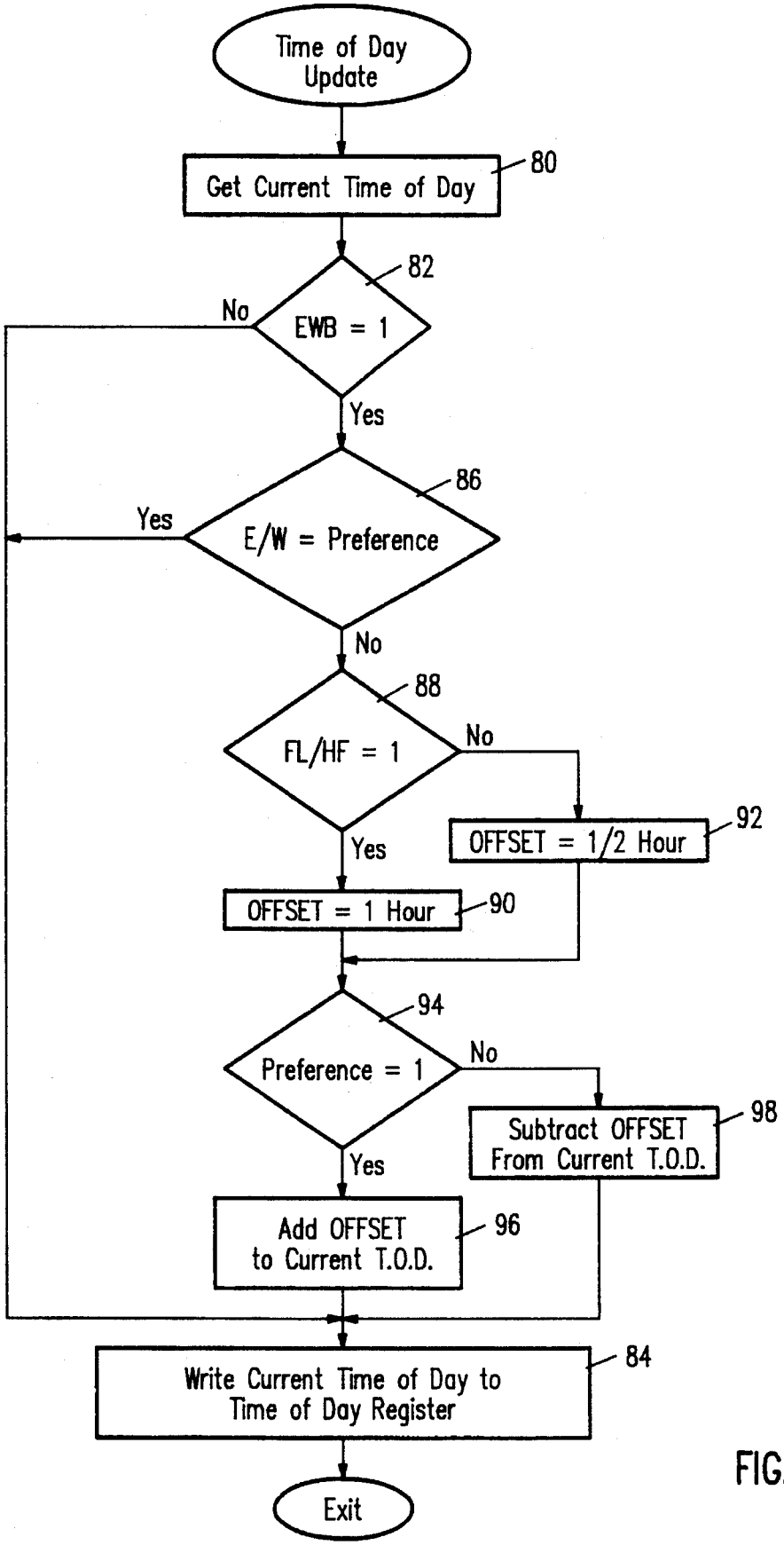

FIGS. 5–7 detail a specific implementation of the present invention accounting for time zone preference between one of two adjacent time zones, e.g., the time zones 16*a* and 16*b* of FIG. 1, and time keeping functions within the reception area 10 to meet user preference with respect to time display according to one of the time zones 16*a* and 16*b*. Thus, the implementation of FIGS. 5–7 resolves problems associated with a reception area spanning multiple time zones.

FIG. 5 illustrates in detail an implementation of the message packet $P_0$ wherein the time of day field 36 is as described above, i.e., a representation of current local time in hours, minutes and seconds. The time zone identification field 34 comprises individual bits 34*a*–34*c*. Each of the transmission facilities 14 transmits this message packet $P_0$ on a regular basis according to system protocol to make available to the paging devices 18 the time zone identification field 34 and time of day field 36.

Bit 34*a* of field 34 is an east/west boundary bit identifying whether or not the originating transmitter is in or near a time zone boundary area. If the east/west boundary bit 34*a* is a one, for example, then the transmitter is near a time zone boundary. If the east/west boundary bit 34*a* is a zero, then the originating transmitter is not near a time zone boundary. The east/west boundary bit 34*a* allows paging devices 18 to determine how the received time of day field 36 is to be treated. If the east/west boundary bit 34*a* is a zero, then no issue as to conversion to a preferred time zone is presented and the transmitted local time of day field 36 may be taken literally. If, however, the east/west boundary bit 34*a* is a one, then the paging device 18 may need to offset the received time of day field 36 according to user preference. To do this, however, the paging device 18 must know which time zone the time of day field 36 references. This is provided by the second bit 34*b*, referred to herein as the east/west bit 34*b*.

The east/west bit 34*b* identifies a transmitter as transmitting time of day with respect to west time zone 16*a* or east time zone 16*b*. Thus, if east/west bit 34*b* is a one, then the time of day field 36 references east time zone 16*b*. If the east/west bit 34*b* is zero, however, then the transmitted time of day field 36 references west time zone 16*a*.

The third bit 34*c* indicates the offset between the east and west time zones 16*a* and 16*b*. More particularly, bit 34*c*, referred to herein as full/half bit 34*c*, equals one when the time difference between the east and west time zones is one hour, and equals zero when the time difference is one-half hour.

FIG. 6 illustrates the time zone preference register 54 of paging device 18 implemented as a single preference bit 54*a*. When the east/west preference bit 54*a* of register 54 equals one it indicates a preference for the east time zone 16*b*, and when it equals a zero it indicates a preference for the west time zone 16*a*. When the preference bit 54*a* equals the east/west bit 34*b*, then the time of day presented in field 36 can be accepted as received and loaded into the time of day register 50. If, however, the preference bit 54*a* does not match the east/west bit 34*b*, then the transmitted time of day in field 36 must be modified according to user preference, i.e., adding a full or half hour offset if the receiver preference is east time zone 16*b*, or subtracting a full or half hour offset if receiver preference is west time zone 16*a*.

FIG. 7 illustrates programming of each paging device 18 according to use of the time zone identification field 34, time of day field 36, and time zone preference bit 54*a*. In FIG. 7, the time of day update routine begins in block 80 with paging device 18 activating its radio receiving circuitry and capturing the message packet $P_0$ containing the time zone identification field 34 and time of day field 36 as illustrated in FIG. 5. In decision block 82, paging device 18 interrogates the east/west boundary bit 34*a* of field 34 to determine if an issue as to time zone offset exists. If the east/west boundary bit 34*a* does not equal one, indicating that the originating transmitter is not near a time zone boundary, then processing branches directly to block 84 where the received current time of day provided in field 36 of message packet $P_0$ is written directly into the time of day register 50 to update the paging device 18 time display. The writing of a received current time of day reference into the time of day register 50 may include a predetermined fixed offset to account for a difference in time between the time of day reference and the time of writing the time of day reference into register 50 as a function of paging device 18 processing time.

If the east/west boundary bit 34*a* equals one, indicating that the originating transmitter is near a time zone boundary, then processing branches from decision block 82 to decision block 86 where paging device 18 compares the east/west bit 34*b* with the preference bit 54*a*. If the east/west bit 34*b* as transmitted in association with the current time of day field 36 equals the preference bit 54*a*, then the received current time of day matches the paging device 18 preference and no time zone offset in the received current time of day is required. Accordingly, processing would branch directly from decision block 86 to block 84 where the received current time of day is written into the time of day register 50.

If, however, the east/west bit 34*b* does not match the preference bit 54*a*, then the received current time of day must be offset to a different time zone according to user preference. Processing proceeds to decision block 88 to determine the magnitude of offset required. In decision block 88, the full/half bit 34*c* is interrogated and if equal to one then processing passes through block 90 where a variable OFFSET is set to one hour, otherwise processing passes through block 92 where the variable OFFSET is set to one-half hour. In either case processing reaches decision block 94 where paging device 18 interrogates the preference bit 54*a*. If the preference bit 54*a* equals one, i.e., indicates a preference for the eastern time zone 16*b*, then processing branches to block 96 where the variable OFFSET is added to the received current time of day value, and processing then proceeds to block 84. Otherwise, if the preference bit 54*a* equals zero then processing branches to block 98 where the variable OFFSET is subtracted from the current time of day value. Processing then proceeds to block 84 where the modified current time of day is written into the time of day register 50.

As may be appreciated, the user preference for west time zone 16*a* or east time zone 16*b*, as represented by the preference bit 54*a* of paging device 18, may be established according to a variety of mechanisms. For example, the user could manipulate control buttons of the paging device 18 to establish a given value in the preference register 54. Alternatively, the paging system could transmit a special configuration packet recognized by the paging device 18 as configuration data to be written into the preference register 54. In any case, the value held in preference register 54 is a user preference for time display relative to a given time zone. In this manner, the user can travel throughout a reception area including a time zone boundary and including transmitted time of day information referencing different time zones. Despite such variation in paging device position within the reception area 10 and variation in time of day values received, the paging device 18 can present the time of day consistently with reference to one time zone and according to user preference.

Figure 8:
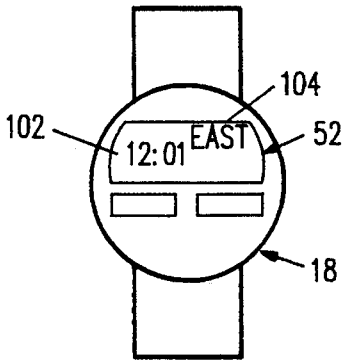
FIG. 8 illustrates display of a time keeping device indicating that the receiver is in a reception area including a time zone boundary, and whether the time displayed is according to an east time or a west time zone.

As previously noted, bit 34*a* indicates whether or not the originating transmitter is in or near a time zone boundary. Bit 34*a* may be interrogated for presenting a corresponding display to the user. More particularly, and as illustrated in FIG. 8, display 52 presents a time of day 102, and an east/west boundary indicator 104. As shown in FIG. 8, the east/west indicator 104 presents the word "east" when time display 102 is with reference to an eastern one of two adjacent time zones, e.g., east time zone 16*b* (FIG. 1). Similarly, the east/west indicator 104 shows "west" when display 102 is with reference to a western one of two adjacent time zones, e.g., west time zone 16*a*. As may be appreciated, the indicator 104 need not literally present the words "east" or "west", but could use other symbolic notation to convey the fact that paging device 18 is in a boundary condition, i.e., near a time zone, and whether the receiver is displaying time of day with reference to an east or a west time zone. As may be appreciated, if the east/west boundary indicator 104 is absent, the user may infer that the device 18 is not in a time zone boundary area. Otherwise, the presence of the east/west indicator 104 indicates reception in an area covering more than one time zone, and the content, i.e., "east" or "west" indication, conveys to the user which one of two time zones are referenced by the time of day display 102.

Thus, an improved method and apparatus for time display in a time keeping system including a time zone boundary has been shown and described. In accordance with the present invention, time keeping and time display may match user preference even in an area spanning a time zone boundary. Under such arrangement, a user may designate a given time zone as a preference for time keeping and the paging system and time keeping circuitry of the paging device may receive time of day transmissions relative to a second time zone, but accommodate the user preference in display.

It will be appreciated that the present invention is not restricted to the particular embodiment that has been described and illustrated, and that variations may be made therein without departing from the scope of the invention as found in the appended claims and equivalents thereof.

What is claimed is:

1. A method of time keeping comprising:

transmitting a time of day reference by radio signal in association with a given time zone identification;

receiving said time of day reference and time zone identification at a time keeping device, said time keeping device maintaining a time zone preference indicator;

comparing at said time keeping device said time zone preference and said time zone identification; and offsetting for subsequent time keeping said time of day reference according to said comparing step.

2. A method according to claim 1 wherein said transmitting step is conducted in a reception area including a boundary between an east time zone and a west time zone and said given time zone identification identifies one of said east time zone and said west time zone, and wherein said time zone preference indicator identifies one of said east time zone and said west time zone.

3. A method according to claim 2 wherein said given time zone identification is a binary value.

4. A method according to claim 2 wherein said time zone preference indicator is a binary value.

5. A method according to claim 1 wherein said transmitting step further includes transmitting in association with said time of day reference an indication of transmission in proximity to a time zone boundary and said time keeping device interrogates said indication of transmission in proximity to a time zone boundary and executes said comparing step in response to a positive indication of transmission in proximity to a time zone boundary.

6. A time keeping system comprising:

a radio signal transmission system broadcasting a plurality of time of day references within a reception zone including a time zone boundary, each time of day reference including identification of a given time zone; and at least one radio signal receiving device receiving a selected one of said time of day references, having a preference for display according to a preferred time zone, means for comparing said given time zone as received in association with one of said time of day references, and means for offsetting said time of day reference when said given time zone and said preferred time zone do not match.

7. A system according to claim 6 wherein said identification of a given time zone identifies one of two adjoining time zones defined by said time zone boundary.

8. A system according to claim 7 wherein said identification of a given time zone is a binary value identifying an east or a west one of said two adjoining time zones.

9. A system according to claim 6 wherein each time of day reference further includes indication of transmission in proximity to a time zone boundary and said radio signal receiving device interrogates said indication of transmission in proximity to a time zone boundary and executes said comparing and offsetting steps conditionally as a function of said indication of transmission in proximity to a time zone boundary.

10. A system according to claim 9 wherein said indication of transmission in proximity to a time zone boundary further includes indication of time offset between adjacent time zones defined by said boundary.

11. A system according to claim 10 wherein said time offset is a binary value indicating one of a full hour offset and half-hour offset.

12. In a method of time keeping having a time keeping system broadcasting by radio signal time of day information to a plurality of radio signal receiving devices employing said broadcast time of day information to maintain and display time of day, an improvement comprising the steps of:

transmitting in conjunction with said broadcast time of day information an indication of a time zone associated with said broadcast time of day information;

maintaining at each of said plurality of radio signal receiving devices a time zone preference indicator; and comparing at each of said plurality of radio signal receiving devices upon receipt of said broadcast time of day information said indication of a time zone with said time zone preference indicator and if a match condition results then accepting for time keeping said broadcast time of day information, and if a match condition does not result then offsetting for use in time keeping said broadcast time of day information as a function of said time zone preference indicator.

13. An improvement according to claim 12 wherein said indication of time zone includes an indication Of broadcast in proximity to a time zone boundary and said radio signal receiving devices first interrogate said indication of broadcast in proximity to a time zone boundary and accept for time keeping said broadcast time of day information for display when said broadcast time of day information is not broadcast in proximity of a time zone boundary, said radio signal receiving devices executing said comparing step only when said broadcast time of day information is indicated as being in proximity to a time zone boundary.

14. An improvement according to claim 12 wherein said indication of broadcast in proximity to a time zone boundary further indicates indication of time offset between adjacent time zones defined by said boundary.

15. An improvement according to claim 14 wherein said time offset is a binary value indicating one of a full hour offset and half-hour offset.

* * * * *